US006374422B1

(12) United States Patent
Gonzalez et al.

(10) Patent No.: US 6,374,422 B1
(45) Date of Patent: Apr. 23, 2002

(54) HEAD GUARD FOR SOCCER PLAYERS

(76) Inventors: Hugo Gonzalez; Maria Gonzalez; Oscar Gonzalez, all of 950 S. Clela Ave., Los Angeles, CA (US) 90022

( * ) Notice: Subject to any disclaimer, the term of this patent is extended or adjusted under 35 U.S.C. 154(b) by 0 days.

(21) Appl. No.: 09/853,494

(22) Filed: May 11, 2001

(51) Int. Cl.[7] ..... A63B 71/10
(52) U.S. Cl. ..... 2/425
(58) Field of Search ..... 2/425, 411, 412, 2/DIG. 11

(56) References Cited

U.S. PATENT DOCUMENTS

| | | | | |
|---|---|---|---|---|
| 532,567 | A | * | 1/1895 | Larwood, Jr. |
| 3,600,713 | A | | 8/1971 | Holt |
| 4,062,067 | A | | 12/1977 | Franzen |
| 4,698,852 | A | | 10/1987 | Romero |
| 4,947,488 | A | | 8/1990 | Ashinoff |
| 5,377,360 | A | | 1/1995 | Fleitman |
| D370,309 | S | | 5/1996 | Stucky |
| 5,790,988 | A | * | 8/1998 | Guadagnino, Jr. et al. |
| 5,946,734 | A | * | 9/1999 | Vogan |

FOREIGN PATENT DOCUMENTS

| | | | |
|---|---|---|---|
| DE | 10003125 | * | 8/2001 |
| FR | 2390116 | * | 12/1978 |
| WO | 9929199 | * | 6/1999 |

* cited by examiner

*Primary Examiner*—Rodney M. Lindsey

(57) ABSTRACT

A head guard for soccer players for protecting the forehead of a soccer player when the forehead is struck with a soccer ball. The head guard for soccer players includes a plate having a outer surface and an inner surface. The plate has a bottom edge, a pair of side edges and a top edge. The inner surface is concave and the outer surface is convex. The bottom edge generally lies in a plane such that the plate generally arcs back from the bottom edge to the top edge. A head band is elongated and has a pair of ends. Each of the ends of the head band is attached to the plate and defines a loop for extending around a head such that the plate may be abutted against the forehead of the wearer. Each of the ends of the head band is positioned adjacent to the bottom edge and one of the side edges.

7 Claims, 2 Drawing Sheets

HEAD GUARD FOR SOCCER PLAYERS

BACKGROUND OF THE INVENTION

1. Field of the Invention

The present invention relates to head protection devices and more particularly pertains to a new head guard for soccer players for protecting the forehead of a soccer player when the forehead is struck with a soccer ball.

2. Description of the Prior Art

The use of head protection devices is known in the prior art. More specifically, head protection devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,698,852; U.S. Pat. No. 4,947,488; U.S. Des. Pat. No. 370,309; U.S. Pat. No. 5,377,360; U.S. Pat. No. 4,062,067; and U.S. Pat. No. 3,600,713.

While these devices fulfill their respective, particular objectives and requirements, the aforementioned patents do not disclose a new head guard for soccer players. The inventive device includes a plate having an outer surface and an inner surface. The plate has a bottom edge, a pair of side edges and a top edge. The inner surface is concave and the outer surface is convex. The bottom edge generally lies in a plane such that the plate generally arcs back from the bottom edge to the top edge. A head band is elongated and has a pair of ends. Each of the ends of the head band is attached to the plate and defines a loop for extending around a head such that the plate may be abutted against the forehead of the wearer. Each of the ends of the head band is positioned adjacent to the bottom edge and one of the side edges.

In these respects, the head guard for soccer players according to the present invention substantially departs from the conventional concepts and designs of the prior art, and in so doing provides an apparatus primarily developed for the purpose of protecting the forehead of a soccer player when the forehead is struck with a soccer ball.

SUMMARY OF THE INVENTION

In view of the foregoing disadvantages inherent in the known types of head protection devices now present in the prior art, the present invention provides a new head guard for soccer players construction wherein the same can be utilized for protecting the forehead of a soccer player when the forehead is struck with a soccer ball.

The general purpose of the present invention, which will be described subsequently in greater detail, is to provide a new head guard for soccer players apparatus and method which has many of the advantages of the head protection devices mentioned heretofore and many novel features that result in a new head guard for soccer players which is not anticipated, rendered obvious, suggested, or even implied by any of the prior art head protection devices, either alone or in any combination thereof.

To attain this, the present invention generally comprises a plate having a outer surface and an inner surface. The plate has a bottom edge, a pair of side edges and a top edge. The inner surface is concave and the outer surface is convex. The bottom edge generally lies in a plane such that the plate generally arcs back from the bottom edge to the top edge. A head band is elongated and has a pair of ends. Each of the ends of the head band is attached to the plate and defines a loop for extending around a head such that the plate may be abutted against the forehead of the wearer. Each of the ends of the head band is positioned adjacent to the bottom edge and one of the side edges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new head guard for soccer players apparatus and method which has many of the advantages of the head protection devices mentioned heretofore and many novel features that result in a new head guard for soccer players which is not anticipated, rendered obvious, suggested, or even implied by any of the prior art head protection devices, either alone or in any combination thereof.

It is another object of the present invention to provide a new head guard for soccer players which may be easily and efficiently manufactured and marketed.

It is a further object of the present invention to provide a new head guard for soccer players which is of a durable and reliable construction.

An even further object of the present invention is to provide a new head guard for soccer players which is susceptible of a low cost of manufacture with regard to both materials and labor, and which accordingly is then susceptible of low prices of sale to the consuming public, thereby making such head guard for soccer players economically available to the buying public.

Still yet another object of the present invention is to provide a new head guard for soccer players which provides in the apparatuses and methods of the prior art some of the advantages thereof, while simultaneously overcoming some of the disadvantages normally associated therewith.

Still another object of the present invention is to provide a new head guard for soccer players for protecting the forehead of a soccer player when the forehead is struck with a soccer ball.

Yet another object of the present invention is to provide a new head guard for soccer players which includes a plate having a outer surface and an inner surface. The plate has a bottom edge, a pair of side edges and a top edge. The inner surface is concave and the outer surface is convex. The bottom edge generally lies in a plane such that the plate generally arcs back from the bottom edge to the top edge. A head band is elongated and has a pair of ends. Each of the ends of the head band is attached to the plate and defines a loop for extending around a head such that the plate may be abutted against the forehead of the wearer. Each of the ends of the head band is positioned adjacent to the bottom edge and one of the side edges.

Still yet another object of the present invention is to provide a new head guard for soccer players that forms a shield for the forehead while allowing the remainder of the head exposed for cooling purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
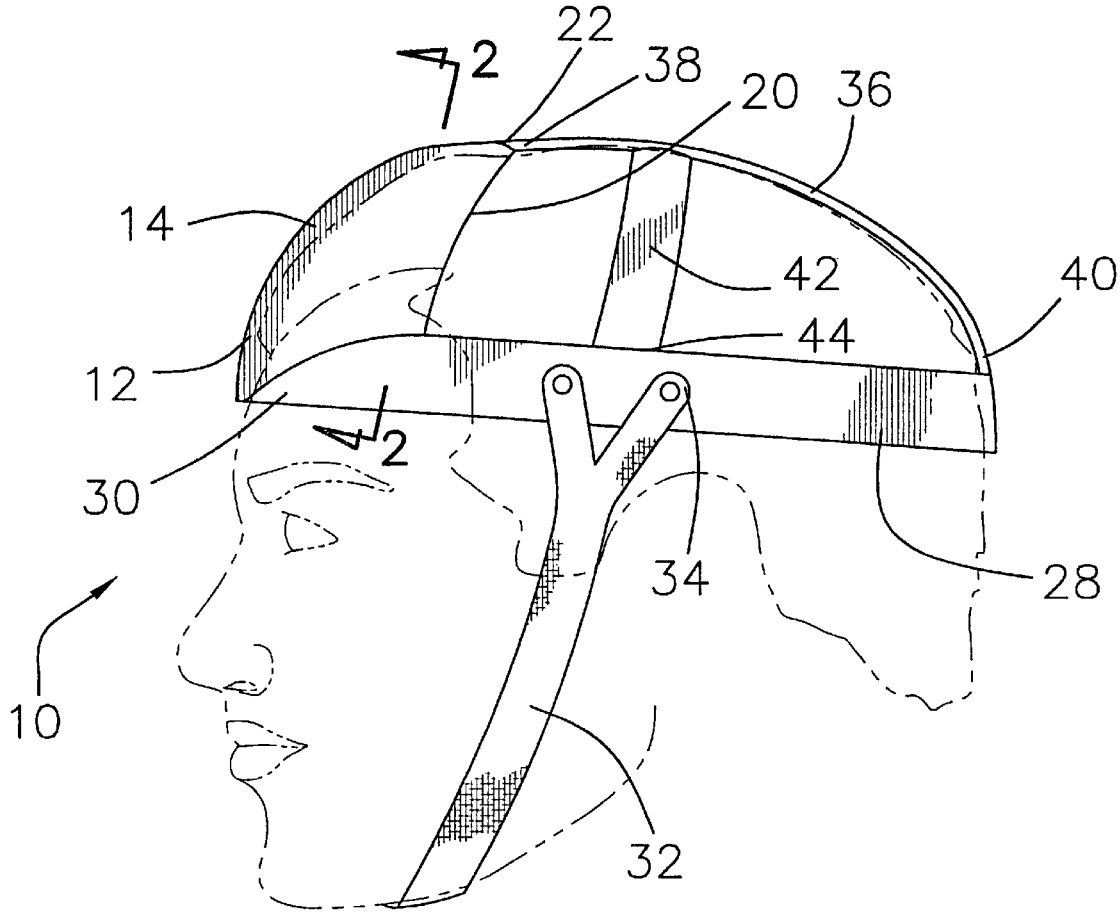
FIG. 1 is a schematic side view of a new head guard for soccer players according to the present invention.
Figure 2:
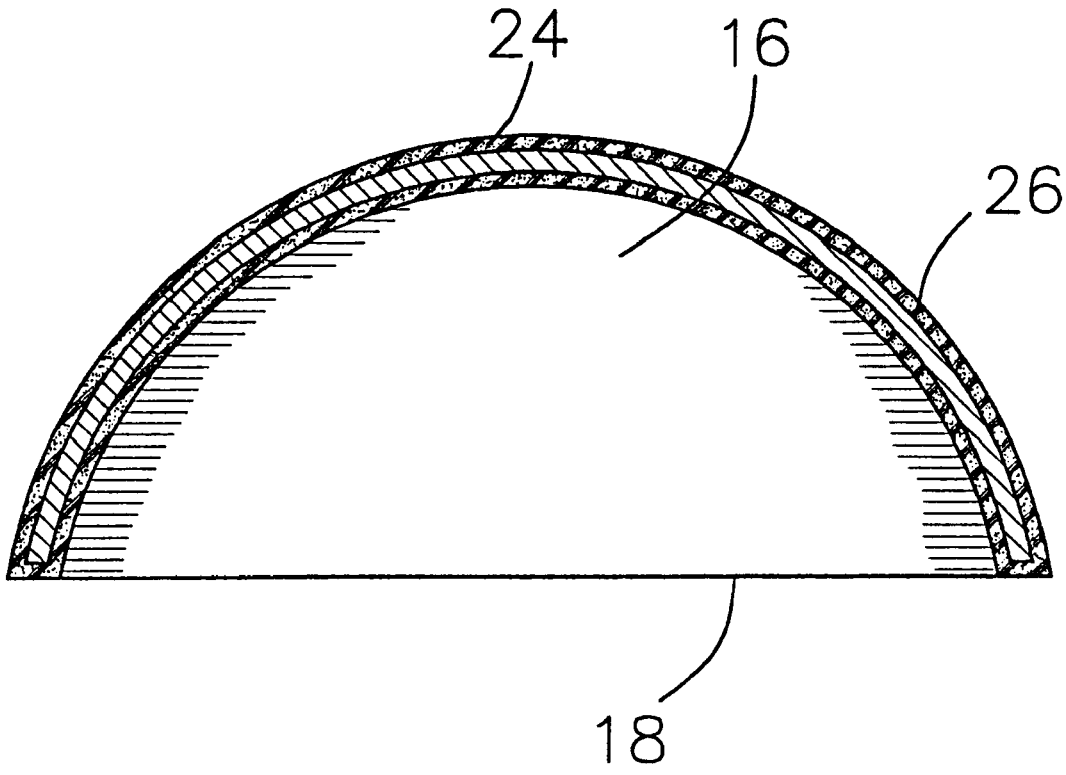
FIG. 2 is a schematic cross-sectional view taken along line 2—2 of the present invention.

With reference now to the drawings, and in particular to FIGS. 1 and 2 thereof, a new head guard for soccer players embodying the principles and concepts of the present invention and generally designated by the reference numeral 10 will be described.

As best illustrated in FIGS. 1 and 2, the head guard for soccer players 10 generally comprises a plate 12 having a outer surface 14, an inner surface 16, a bottom edge 18, a pair of side edges 20 and a top edge 22. The inner surface 16 is concave and the outer surface is convex. The bottom edge 18 lies in a plane such that the plate generally arcs back generally between 70 degrees and 90 degrees from the bottom edge to the top edge 22. The plate 12 comprises a metallic material 24 having a coating 26 thereon. The coating 26 comprises a plastic material.

A head band 28 is elongated and has a pair of ends 30. Each of the ends 30 of the head band 28 is attached to the plate 12 and defines a loop for extending around a head such that the plate 12 is positioned abutting the forehead of the wearer. Each of the ends 30 of the head band 28 is positioned adjacent to the bottom edge 18 and one of the side edges 20. The head band 28 comprises a plastic material.

A chin strap 32 is elongated and has a pair of ends 34 each coupled to the head band 28 and located generally on opposite sides of the head band 28 such that the chin strap 32 is abutted against each side of a face of a wearer when the plate 12 is abutted against the forehead of the wearer. The chin strap 32 defines a loop for extending under the chin of a wearer.

A first elongated portion 36 has a first end 38 attached to the top edge 22 of the plate 12 and a second end 40 attached to the head band 28. The first elongated portion 36 generally traverses the loop defined by the head band 28. A second elongated portion 42 has a pair of ends 44 each coupled to the head band 28. The second elongated 42 portion traverses and is coupled to the first elongated portion 36. Each of the first 36 and second 42 elongated portions is arced upwardly and comprises a plastic material.

In use, the device 10 is positioned on the head of a user such that the inner surface 16 of the plate 12 is abutting the forehead of the wearer and the chin strap 32 positioned under the chin of the wearer. The elongated portions 36, 42 traverse the crown of the head to provide more stability of the device 10. When hitting a soccer ball with the head, the plate 12 reduces the risk of a head trauma injury.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A head guard device for positioning on the head of a user to protect the forehead when playing soccer, said device comprising:

a plate having a outer surface and an inner surface, said plate having a bottom edge, a pair of side edges and a top edge, said inner surface being concave and said outer surface being convex, said bottom edge generally lying in a plane such that said plate generally arcs back from said bottom edge to said top edge; and a head band being elongated and having a pair of ends, each of said ends of said head band being attached to said plate and defining a loop for extending around a head such that said plate may be abutted against the forehead of the wearer, each of said ends of said head band being positioned adjacent to said bottom edge and one of said side edges.

2. The head guard device as in claim 1, wherein said plate generally arcs back generally between 70 degrees and 90 degrees from said bottom edge to said top edge.

3. The head guard device as in claim 1, wherein said plate comprises a metallic material having a coating thereon, said coating comprising a plastic material.

4. The head guard device as in claim 1, further including:

a chin strap being elongated and having a pair of ends each coupled to said head band and located generally on opposite sides of said head band such that said strap is abutted against each side of a face of a wearer when said plate is abutted against the forehead of the wearer, said chin strap defining a loop for extending under the chin of a wearer.

5. The head guard device as in claim 1, further including:

a first elongated portion having a first end attached to said top edge of said plate and a second end attached to said head band, said first elongated portion generally traversing said loop defined by said head band, said first elongated portion being arced upwardly.

6. The head guard device as in claim 5, further including:

a second elongated portion having a pair of ends each coupled to said head band, said second elongated portion traversing said first elongated portion.

7. A head guard device for positioning on the head of a user to protect the forehead when playing soccer, said device comprising:

a plate having a outer surface and an inner surface, said plate having a bottom edge, a pair of side edges and a top edge, said inner surface being concave and said outer surface being convex, said bottom edge generally lying in a plane such that said plate generally arcs back generally between 70 degrees and 90 degrees from said bottom edge to said top edge, said plate comprising a metallic material having a coating thereon, said coating comprising a plastic material;

a head band being elongated and having a pair of ends, each of said ends of said head band being attached to said plate and defining a loop for extending around a head such that said plate is positioned abutting the forehead of the wearer, each of said ends of said head band being positioned adjacent to said bottom edge and one of said side edges, said head band comprising a plastic material;

a chin strap being elongated and having a pair of ends each coupled to said head band and located generally on opposite sides of said head band such that said strap is abutted against each side of a face of a wearer when said plate is abutted against the forehead of the wearer, said chin strap defining a loop for extending under the chin of a wearer;

a first elongated portion having a first end attached to said top edge of said plate and a second end attached to said head band, said first elongated portion generally traversing said loop defined by said head band; and a second elongated portion having a pair of ends each coupled to said head band, said second elongated portion traversing said first elongated portion, each of said first and second elongated portions being arced upwardly and comprising a plastic material.

* * * * *